United States Patent [19]

Mares et al.

[11] 4,063,885

[45] Dec. 20, 1977

[54] SINGLE-TREATMENT RADIATION PROCESS FOR IMPARTING DURABLE SOIL-RELEASE PROPERTIES TO COTTON AND COTTON-POLYESTER BLEND FABRICS

[75] Inventors: Trinidad Mares; Jett C. Arthur, Jr., both of Metairie; James A. Harris, Pearl River, all of La.

[73] Assignee: The United States of America as represented by the Secretary of Agriculture, Washington, D.C.

[21] Appl. No.: 656,038

[22] Filed: Feb. 6, 1976

[51] Int. Cl.[2] ..... D06M 9/00; C08L 1/00

[52] U.S. Cl. ..... 8/115.7; 8/18 A; 8/115.6; 8/120; 8/DIG. 18; 204/159.12; 204/17.4 GC

[58] Field of Search ..... 204/159.12; 260/17.4 GC; 8/116 R, 115.7, 120, 115.6, 18 A

[56] References Cited

U.S. PATENT DOCUMENTS

| | | | |
|---|---|---|---|
| 3,522,158 | 7/1970 | Garnett et al. | 204/159.12 |
| 3,567,606 | 3/1971 | Das Gupta et al. | 204/159.12 |
| 3,733,257 | 5/1973 | Arthur et al. | 204/159.12 |
| 3,926,549 | 12/1975 | Mares et al. | 8/116 R |

*Primary Examiner*—Richard B. Turer
*Attorney, Agent, or Firm*—M. Howard Silverstein; David G. McConnell; Salvador J. Cangemi

[57] ABSTRACT

A single treatment process for imparting durable soil release and soil repellent properties to cotton fabrics and to cotton polyester blend fabrics with widely different constructions and compositions comprising free radical initiated reactions of a vinyl monomer that contains carboxyl functional groups with cotton and polyester in the fabrics, is described. Of special interest is the unusually high efficiency of removal of both aqueous soils and oily soils from the treated fabrics and the unusually high durability of the properties of treated cotton fabrics and cotton polyester blend fabrics with widely different constructions and compositions to laundering and cleaning.

5 Claims, No Drawings

SINGLE-TREATMENT RADIATION PROCESS FOR IMPARTING DURABLE SOIL-RELEASE PROPERTIES TO COTTON AND COTTON-POLYESTER BLEND FABRICS

This invention relates to a single treatment process for imparting durable soil release and soil repellent properties to cotton fabrics and to cotton polyester blend fabrics with widely different constructions.

More specifically, this invention relates to a nonpolluting process for imparting soil release properties to cotton and cotton polyester blend fabrics with different constructions and compositions, by introducing selected electron-donating carboxylic acid groups onto the fabric substrates and thereby increasing soil release, soil repellency, and moisture regain properties of the textile fabric products. The single treatment process involves free radical initiated reaction between an acrylic monomer containing carboxyl functional groups and cotton and polyester components comprising the fabric blend, thereby producing a fibrous cotton polyester acrylic copolymer textile fabric product, with durable soil release and soil repellent properties with high moisture regains. The imparted soil-release properties have been found to be durable to home-type laundering. The process herein described and the cotton polyester acrylic copolymer textile fabric products find utility in workers' uniforms supplied by commercial firms, hospital linens and gowns, as well as wash-wear and durable-press garments, or any other product where durable soil-release and soil repellency are required and desired.

BACKGROUND AND PRIOR ART

In recent years, numerous soil release finishes have been reported in the patent and other literature; a serious drawback, however, with many of the conventional soil release finishes (particularly, the emulsion or solution types that are padded-on, dried and cured) has been their insufficient fastness to laundering, as has been shown in Textile Research J. 41, 732 (1971) by N. T. Liljemark and H. Asnes; and also, in J. Appl. Polym. Sci., 16, 1235 (1972) by C. E. Warburton, Jr., and L. T. Flynn. In some instances, methods of treatments consist in simple depositing compounds, monomers or polymers between fibers and yarns or of forming a coating on the surface of a substrate. Coover, et al., (U.S. Pat. No. 2,992,943) teaches the application of water-soluble alkyl titanates for prevention of dry soiling; consequently, this finish is only suitable for dry cleaning of these treated products.

Caldwell (U.S. Pat. No. 3,236,685) teaches a coating composition for hydrophobic films and fibers, employing a polymeric polybasic acid and part of the coating is crosslinked with a polyol or an epoxide to form ester linkages giving a hydrophilic insoluble coating with anti-static and soil release properties. While the treatments described in patents by Coover et al. and Caldwell are effective as soil resistant or soil release treatments they are not generally durable to laundering.

OBJECTIVES OF THE INSTANT INVENTION

The main object of this invention is to provide a single-treatment process for imparting durable soil release properties to cotton and cotton-polyester blend fabrics with different construction and compositions, such as woven and nonwoven products, which find utility in rental-type workers' uniforms, hospital linens and patients' gowns and, particularly, in wash-wear and durable press garments or in any other dry goods which could benefit from this treatment.

Another object of this invention is to increase the capacity of these textile fabric blends to absorb and transmit more water vapor, that is, to increase their water regain properties.

A further object of the invention is to alter the surface properties of cotton and cotton-polyester blend fabrics with different constructions and compositions, which could contribute to the process of soil release.

SUMMARY OF THE INVENTION

The instant invention defines a process which produces distinct improvements in durability and quality of soil release properties for cotton and cotton-polyester blend fabrics with a different construction and composition, such as 100% cotton fabrics, fabrics that contain 75% with 50% polyester plus 50% cotton in the fill construction and with 50% polyester plus 50% cotton in the warp construction, and fabrics that contain 50% cotton with 50% polyester plus 50% cotton in both the fill and warp constructions; by a reaction between radiation-activated cotton and polyester in the fabrics and an acrylic monomer, having less than 8 carbon atoms and containing carboxyl functional groups. The monomer concentration may be varied between 2% and 15% by volume, but a range of 8–10% by volume is preferred. While the temperature of the reaction may vary between 15° and 40° C., the preferred temperature range is 20°–28° C.

Reaction times can be varied, depending on the desired add-on. Through copolymerization reactions by this process the surface properties of cotton and cotton-polyester blend fabrics were altered and the electron-donating carboxyl groups introduced contributed to the processes of soil release and soil repellency. The fibrous copolymer textile products have shown soil repellency, high soil removal efficiencies, increased moisture regains, and durable press properties. Textile properties of these copolymers were generally as high as, and in most cases higher than, those of unmodified cotton fabric. The instant invention, therefore, defines a distinct *improvement* in permanently and durably adding the properties of soil release, soil repellency and increased moisture regains to these copolymer textile products, with little or no loss of, and in most cases, improvement of their durable-press and other properties.

We have unexpectedly discovered that durable soil repellency and soil release properties can be imparted to cotton and cotton-polyester blend textiles even when in the past construction requirements and composition requirements called for entirely different treatments. By the new process a single formulation is now used, and the moisture regains are increased considerably over those of their respective unmodified control fabrics.

The process of the instant invention differs from the prior art in that a reaction is involved in which a covalent linkage is effected between the vinyl group of the monomer, such as methacrylic acid, and the radiation-activated cellulose molecule of cotton and polyester molecule, and cotton and cotton-polyester blend textile products with different constructions and compositions. The ether linkage thus formed between the cellulose molecule or the linkage with the polyester molecule in the textile fabrics and the monomer or polymer is the important factor in the process of the instant invention, that results in a durable soil release finish for cotton and cotton-polyester blend textile products with different constructions and compositions.

In contrast to the process of the instant invention are solution or emulsion-type treatments in which reagents are padded-on, dried, and cured, and no covalent bond between the substrate and the reagent occurs. The latter type treatments, therefore, are usually not durable to laundering, because they, in effect, merely deposit polymer between fibers and yarns, or form a surface coating which can be removed by mechanical action and washed out during laundering. Another advantage of the present invention is that excessive homopolymerization does not occur, since the free radicals, that initiate the copolymerization reaction, are trapped in the cotton-polyester matrix and are not present in solution, limiting the reaction to the active sites in cellulose and polyester molecules. Still further, another advantage of this invention is that there is neither a curing step involved, nor a chemical catalyst present, as in the prior art; accordingly, these sources of degradative effects are eliminated by the process of this invention. Further since there is no chemical catalyst used in the instant invention, there is no subsequent water pollution as when chemical catalysts are water-washed out of the finished textile products as in the prior art.

The effectiveness of the process can best be viewed by a cursory study of the summarized results obtained. The data tabulated below, show, for example, the effectiveness of the single treatment process, as measured by the values obtained in *aqueous* and *oily soil removal*, bearing in mind that a single treatment is employed regardless of the different constructions or differences in composition of the textiles employed to illustrate the invention.

| (a) | (b) | Fabric Composition and Construction | Soil Removal Efficiency, % Aqueous Soil | Oily Soil |
|---|---|---|---|---|
| | | All Cotton Fabrics cotton (100%) in both warp and fill constructions | | |
| 1,5 | 0 | | 31 | 48 |
| 1,5 | 15 | | 64 | 75 |
| 1,5 | 22 | | 98 | 69 |
| | | 75% Cotton Fabrics cotton (100%) in warp construction; cotton (50%) and polyester (50%) in fill construction | | |
| 2,6 | 0 | | 53 | 55 |
| 2,6 | 9 | | 86 | 70 |
| 2,6 | 17 | | 98 | 74 |
| | | 75% Cotton Fabrics cotton (100%) in fill construction; cotton (50%) and polyester (50%) in warp construction | | |
| 3,7 | 0 | | 46 | 53 |
| 3,7 | 7 | | 87 | 71 |
| 3,7 | 18 | | 84 | 71 |
| | | 50% Cotton Fabrics cotton (50%) and polyester (50%) in both warp and filled constructions | | |
| 4,8 | 0 | | 52 | 60 |
| 4,8 | 6 | | 94 | 71 |
| 4,8 | 8 | | 96 | 71 |
| 4,8 | 10 | | 92 | 74 |

(a) For details refer to this Example Number.
(b) Polymethacrylic Acid Add-on, %.

For the preparation of cotton and cotton/polyester acrylic copolymer textile fabrics, commercial fabrics were selected. They were: (1) 75% cotton, made with cotton (100%) in the warp construction and cotton (50%)/polyester (50%) in the fill construction; (2) 75% cotton, made with cotton (100%) in the fill construction and cotton (50%)/polyester (50%) in the warp construction (3) 50% cotton, made with cotton (50%)/polyester (50%) in both the warp and the fill constructions; and (4) 100% cotton in both warp and fill constructions. The cotton fabrics was a plain weave, 3.6 oz/sq yd broadcloth. These fabrics had been heat set, enzymatically desized, alkali scoured and peroxide bleached on a pilot plant scale. Samples of cotton and cotton polyester fabrics were dried over phosphorus pentoxide under vacuum at 25° C for 16 hrs to yield fabrics with a moisture content of about 0.5 percent. The drying step was not essential to the process of this invention; however, the yield of product was increased if the cotton and cotton polyester fabrics were initially dried. Then dried cotton and cotton polyester fabrics in sealed glass tubes was irradiated by exposure of the fabrics to gamma radiation from cobalt-60, a convenient source of high energy radiation, while in a nitrogen atmosphere and at 25° C to a dosage of about one megarad, thereby producing an activated fabric containing long-lived free radicals on cellulose molecules of cotton and on polyester molecules in the textile fabrics. The exposure of the cotton and cotton polyester fabrics to high energy radiation was essential to the process of this invention; however, an exact radiation dosage was not required. Generally, the extent of activation of the cotton and cotton-polyester fabrics, that is, formation of long-lived free radicals on the cellulose and polyester molecules, was directly related to the radiation dosage given; while at higher radiation dosages, greater activation of the cellulose molecules and polyester occurred, also, prohibitive losses in the inherent textile properties of the fabrics were obtained. At a dosage of one megarad, the cotton and cotton polyester fabrics were activated by formation of long-lived free radicals on the cellulose and polyester molecules in the blend textile fabrics, with minimum and acceptable losses in the textile properties of these fabrics. Therefore, in the process of this invention, a dosage of one megarad or less was the dosage used.

The following examples are provided to illustrate the preferred embodiments of the invention and should not be construed as limiting the invention in any manner whatever. Cotton and cotton polyester fabrics were treated as described below, and the soil release (SR) properties of cotton--polymethacrylic acid and cotton polyester--polymethacrylic acid (PMAA) copolymer fabrics are given in the following examples. The first series (9 samples) was soiled with an aqueous soil and SR data are comprised in Examples 1–4; the second series (9 samples) was soiled with an oily soil and these data are included in Examples 5–8. Samples A and E, in Example 1 and 5, refer to the control, an all cotton untreated fabric. Samples B and F in Examples 2 and 6 = a control, a 75% cotton fabric, with cotton (50%)/polyester (50%) in the fill. Samples C and G, in Examples 3 and 7 = control, a 75% cotton fabric, with cotton (50%)/polyester (50%) in the warp construction. Samples D and H, in Examples 4 and 8 = control 50% cotton fabric, with cotton (50%)/polyester (50%) in both warp and fill constructions.

EVALUATION OF THE PRODUCTS OF THE PRESENT INVENTION

Product evaluation of the cotton and cotton/polyester copolymer textiles products was carried out according to the following methods. The extent of soiling and soil release tests were done as recommended by Beninate, et al. in his paper entitled "Soiling and Soil Removal Studies of Some Modified Crosslinked Cottons," which appears in Amer. Dyestuff Reptr. 55 (1966) pp 25-29. Textile testing was done according to American Society for Testing and Materials (ASTM) methods. The ASTM-test designation number and property tested follow: (a) D1682-64, breaking strength; (b) D1424-63, tearing strength; (c) D1175-71, flex and flat abrasion resistance; and (d) D1295-67, conditioned and wet wrinkle recovery.

The polymer add-ons and the moisture regains were determined gravimetrically, based on the dry weight of the samples before and after reactions. Results on % soiling and % soil removal represent an average of eight reflectance measurements on each sample, and soil removed was determined after five home-type laundering cycles. Percent soiling and percent soiling removal were calculated by the following formulas:

$$\% \text{ soiling} = 100\frac{R_o - R_s}{R_o}; \% \text{ soil removal} = 100\frac{R_L - R_s}{R_o - R_s},$$

where $R_o$ = reflectance before soiling; $R_s$ = reflectance after soiling and $R_L$ = reflectance after soiling and home-type laundering.

The following examples are provided to illustrate the instant invention and are not meant to be limiting the invention in any manner whatever.

EXAMPLE 1

All Cotton Fabrics

AQUEOUS SOILING - Cotton (100%) in Both Warp and Fill Constructions

Two radiation-activated samples (Nos. 1 and 2) of 100% cotton fabric A, were reacted by immersing each fabric sample (1 part) at 25° C in a solution (6 parts) of methanol/water (80:20% by volume) with different monomer concentrations and reaction times; these solutions were purged with nitrogen before and after introducing the fabric samples. Sample 1. A 35.3 g. sample of dry cotton fabric was added to a solution containing methanol (188 ml)/water (47 ml) as solvent, and 7.1% (by volume or 18 ml), of glacial methacrylic acid (MAA), then allowed to react, in a nitrogen atmosphere, for 30 minutes. Sample 2. A 34.2 g. sample of dry cotton fabric was allowed to react at 25° C for 70 minutes in a solution containing 6.0% (by volume or 15 ml) of MAA monomer, and methanol (188 ml/water (47 ml), as solvent. After the end of the reactions, Samples 1 and 2 were washed with water, then extracted in methanol/water (80:20% by volume), again washed with water and dried. The extent of reaction was ascertained by determining the increase in dry weight (add-on) over the initial dry weight of the unmodified fabric sample. The products, cotton/polymethacrylic acid (PMAA) copolymer fabric, had PMAA add-ons of 15 and 22% for Samples 1 and 2, respectively. An unmodified cotton fabric sample, and Samples 1 and 2, were soiled with an aqueous soil by a method for soiling and evaluation tests for soil release, as described under "Summary of the Invention." Results of tests are as follows: For fabric Sample A, control, with a PMAA add-on = 0%, the aqueous soiling = 79%; aqueous soil repellancy = 0%; aqueous soil removed (SR) = 24%; and soil removal efficiency = 31%. For Sample 1, with 15% PMAA add-on, the aqueous soiling = 72%; the aqueous soil repellency = 9%; the aqueous soil removed (SR) = 46%; and the soil removal efficiency = 64%. For Sample 2, with a PMAA-add-on = 22%, the aqueous soiling = 54%; aqueous soil repellency = 32%; aqueous soil removed (SR) = 53%; and soil removal efficiency = 98%. Therefore, the preferred add-on for obtaining better soil release properties for (100%) cotton fabrics is 22% PMAA. The moisture regain properties for these copolymers were: regain for the unmodified cotton fabric, A = 6.12%; for Sample 1, regain = 6.77%, and for Sample 2, regain = 7.00%.

EXAMPLE 2

75% Cotton Fabrics

AQUEOUS SOILING — Cotton (100%) in Warp Construction, Cotton (50%) and Polyester (50%) in Fill Construction Two irradiated samples (Nos. 3 and 4) of cotton/polyester fabric B, (which has cotton (50%)/polyester (50l %) in the fill and cotton (100%) in warp construction) were reacted under different experimental conditions. Sample 3. A 32.8 g. sample of cotton/polyester fabric (1 part) was added to a solution (6 parts) consisting of methanol (186 ml/water)46 ml), as solvent, and methacrylic acid (7.2% by volume or 18 ml), and allowed to react, in a nitrogen atmosphere, at 25° C for 15 minutes. Sample 4. A 33.6 g. sample (1 part) of cotton/polyester fabric, (B), was immersed in a solution (6 parts) of methanol (180 ml/water (45 ml), as solvent, and methacrylic acid (6.3% by volume or 15 ml), then allowed to react at 25° C, in a nitrogen atmosphere for 45 minutes. At the end of their reaction periods, Samples 3 and 4 were washed and dried. Methods used for washing, drying and estimating the add-ons of these samples have already been referred to in Example 1. Procedures for soiling fabric samples and tests for evaluation of their soil release properties have also been described earlier. A sample of unmodified cotton/polyester fabric (B) Sample B, control, was soiled and evaluated along with Samples 3 and 4. The add-ons of poly(methacrylic acid) on Samples 3 and 4 were 9% and 17%, respectively. Results of evaluation tests of soiling and soil release and related properties follow: For Sample B, control, with a PMAA-add-on = 0%, the aqueous soiling = 64%; aqueous soil repellency = 20%; aqueous soil removed (SR) = 34%; and soil removal efficiency = 53%. For Sample 3, with a PMAA-add-on = 9%, the aqueous soiling = 57%; the aqueous soil repellency = 29%; aqueous soil removed = 49%; and soil removal efficiency = 86%. For Sample 4, with PMAA = 17%, the aqueous soiling = 53%; aqueous soil repellency = 33%; aqueous soil removal (SR) = 52%; and soil removal efficiency = 98%. Therefore, the preferred add-on, for this particular cotton/polyester fabric (B), is 17%. The regain properties were: For fabric B, control, regain = 5.24%; for Samples 3 and 4, regains were 5.81% and 6.17%, respectively.

EXAMPLE 3

75% Cotton Fabrics

AQUEOUS SOILING — Cotton (100%) in Fill Construction Cotton (50%) and Polyester (50%) in Warp Construction Two samples (Nos. 5 and 6) of irradiated cotton/polyester fabric C, (which contains cotton (50%) polyester (50%) in the warp construction and cotton (100%)

in fill construction) were treated by immersing each sample in a solution containing the same solvent and monomer concentrations, except that their reaction times were different in order to obtain in one instance a high and in the other, a low polymer add-on. Sample 5. 35.8 g. sample (1 part) of fabric was reacted in a solution (6 parts) containing methanol (188 ml/water (47 ml) as solvent, and 7.1% (by volume), or 18 ml of methacrylic acid for 25 minutes at 25° C, in an atmosphere of nitrogen. Sample 6. 34.9 g. of fabric was treated as in Sample 5, except that the reaction time was increased to 80 minutes. Washing and drying procedures and calculation of polymer add-on were the same as stated under Example 1. Methods for evaluation of soiling and soil release properties have been described earlier in this patent application. The polymethacrylic acid add-ons for Samples 5 and 6 were 7% and 18%, respectively. A sample of unmodified cotton/polyester fabric C, was soiled with an aqueous soil, along with Samples 5 and 6, and evaluated for soil release and related properties. Results of evaluation tests are as follows: For Sample C, with PMAA-add-on = 0%, the aqueous soiling = 69% aqueous soil repellency = 14%; aqueous soil removed (SR) = 32%; soil removed efficiency = 46%. For Sample 5, with PMAA-add-on = 7%, the aqueous soiling = 63%; the aqueous soil repellency = 21%; the aqueous soil removed (SR) = 55%; and soil removal efficiency = 87%. For sample 6, with PMAA-add-on = 18%, the aqueous soiling = 62%; aqueous soil repellency = 22%; aqueous soil removed (SR) = 52%; and the aqueous soil removal efficiency = 84%. For this cotton/polyester fabric (C), data indicate better soil release properties at lower polymer add-ons, therefore, about 7% PMAA is preferred. The increases in moisture regain are as follows: For sample C, regain = 3.93%; the regains for samples 5 and 6 were 4.50% and 5.40%, respectively.

EXAMPLE 4

50% Cotton Fabrics

AQUEOUS SOILING — Cotton (50%) and Polyester (50%) in Both Warp and Fill Constructions Three samples (Nos. 7, 8 and 9) of irradiated cotton/-polyester fabric D, (having cotton (50%/)polyester (50%) in both *warp* and *fill* constructions were treated under the same experimental conditions with respect to solvent and monomer concentrations, except that each sample had an increasingly greater reaction time in order to obtain higher polymer add-ons. Sample 7. A 34.7 g. sample (1 part) of fabric D was immersed in a solution (6 parts) containing methanol (180 ml)/water (45 ml) as solvent, and methacrylic acid (10% by volume or 25 ml), and allowing reaction to continue at 25° C, in an atmosphere of nitrogen, for 20 minutes. Sample 8. 33.4 g. sample of Fabric D was reacted as stated in Sample 7, above, except that the reaction time was increased to 27 minutes. Sample 9. A 34.0 g. sample of fabric D was reacted as stated in Sample 7, except that the reaction time was further increased to 36 minutes, to obtain the higher polymer add-on desired. Washing, extracting and drying procedures after each reaction period were done as described in Example 1. The PMAA add-on for sample 7 = 6%; that for Sample 8 = 8%; and for sample 9, the add-on = 10%. A sample of unmodified fabric D (Sample D) was soiled with an aqueous soil along with Samples 7, 8 and 9, and these samples were evaluated for soil release properties as described earlier in this patent application. Results of these evaluation were as follows: For sample D, with PMAA add-on = 0%, the aqueous soiling = 69%; aqueous soil repellency = 13%; aqueous soil removed (SR) = 36%; and soil removal efficiency = 52%. For Sample 7, with PMAA add-on = 6%, the aqueous soiling = 60%; aqueous soil repellency = 25%; aqueous soil removed (SR) = 56%; and aqueous soil removal efficiency = 94%. For Sample 8, with PMAA-add-on = 8%, the aqueous soiling = 61%; aqueous soil repellency = 24%; aqueous soil removal (SR) = 58%; and soil removal efficiency = 96%. For Sample 9, with PMAA add-on = 10%, the aqueous soiling = 61%; aqueous soil repellency = 23%; aqueous soil removed (SR) = 57%; and the soil removal efficiency = 92%. The preferred PMAA add-on for cotton-polyester fabric D is 8%. The moisture regain properties for these samples were as follows: For Sample D, regain = 3.11; for Sample 7, regain = 3.70; for Sample 8, regain = 4.10%; and for Sample 9, regain = 4.38%.

Oily Soiling and Soil Release Properties of Cotton — and Cotton/Polyester — PMAA Copolymer Fabrics are given in Examples 5–8 below.

EXAMPLE 5

All Cotton Fabrics

OILY SOILING — Cotton (100%) in Both Warp and Fill Constructions

Two samples (Nos. 10 and 11) of irradiated (100%) cotton fabric E were treated under the same conditions as described in Example 1; Sample 10 was treated as was Sample 1, while Sample 11, as Sample 2. The products were cotton/polymethacrylic acid (PMAA) copolymer fabrics. Samples 10 and 11 along with a sample of unmodified cotton fabric E, (Sample E), were soiled with an oily soil, and then, these fabrics were evaluated for soil release and related properties by methods described earlier under "Summary of the Invention." Results of these evaluations gave the following results: For the unmodified cotton fabric Sample E, with a PMAA add-on = 0%, the extent of oily soiling = 91%; the oily soil removed (SR) = 44% and the oily soil removal efficiency = 48%. For cotton/PMAA copolymer fabric Sample 10, with a PMAA add-on = 15%, the oily soiling = 90%; the oily soil removed (SR) = 67%; and the oily soil removal efficiency = 75%. For cotton/-PMAA copolymer fabric, Sample 11, with a PMAA add-on = 22%, the oily soiling = 90%; the oily soil removed (SR) = 62%; and the oily soil removal efficiency = 69%. The moisture regain for the unmodified cotton fabric Sample E = 6.12%; and the regains for Samples 10 and 11 = 6.77% and 7.00%, respectively.

EXAMPLE 6

75% Cotton Fabrics

OILY SOILING — Cotton (100%) in Warp Construction Cotton (50%) and Polyester (50%) in Fill Construction Two samples (Nos. 12 and 13) of irradiated cotton/-polyester fabric F, (which contains cotton (50%)/polyester (50%) in the *fill* construction and cotton (100%) in the warp construction), were reacted with methacrylic acid according to the procedure described in Example 2. Sample 12 was reacted as was Sample 3, and Sample 13, as Sample 4. The products obtained (sample 12 and 13) were cotton/polyester— polymethacrylic acid (PMAA) copolymer fabrics. The copolymer fabrics (samples 12 and 13, along with a sample of unmodified cotton/polyester fabric F, (Sample F), were soiled with an oily soil, and then, evaluated for soil release and related properties, according to methods referred to in Example 5. Results of evaluation tests are as follows: For the unmodified cotton/polyester Sample F, with a PMAA add-on = 0%; the oily soiling = 89%; the oily soil removed (SR), = 49%; and the oily soil removal efficiency = 55%. For cotton/-polyester—PMAA copolymer fabric Sample 12, with a PMAA add-on = 9%, the oily soiling = 89%; the oily soil removed (SR) = 63%; and the oily soil removal efficiency = 70%. For cotton/polyester—PMAA copolymer fabric, Sample 13, with PMAA add-on = 17%, the oily soiling = 89%; the oily soil removed (SR) = 66%; and the oily soil removal efficiency = 74%. The moisture regain for the unmodified cotton/polyester fabric, Sample F = 5.24%, and for cotton/polyester—PMAA copolymer fabric Samples 12 and 13, the regains = 5.81% and 6.17%, respectively, as given in Example 2.

EXAMPLE 7

75% Cotton Fabrics

OILY SOILING — Cotton (100%) in Fill Construction Cotton (50%) and Polyester (50%) in Warp Construction Two samples (Nos. 14 and 15) of irradiated cotton/-polyester fabric G, (which contains cotton (50%) polyester (50%) in the warp construction) were reacted with methacrylic acid as described in Example 3; Sample 14 was treated as Sample 5; and Sample 15 was treated as Sample 6. The products, Samples 14 and 15, were cotton/polyester—polymethacrylic acid copolymer fabrics. A sample of unmodified cotton/polyester fabric G, (Sample G), and samples 14 and 15 were soiled with an oily soil, and then, evaluated for soil release and related properties; the method for soiling, and the evaluation test which were used, have been referred to in Example 5. Results of evaluation tests are as follows: For unmodified cotton/polyester Sample G, with PMAA add-on = 0%, the oily soiling = 91%; the oily soil removed (SR) = 48%; and the oily soil removal efficiency = 53%. For cotton/polyester—PMAA copolymers fabric Sample 14, with PMAA add-on = 7%, the oily soiling = 90%; the oily soil removed (SR) = 64%; and oily soil removal efficiency = 71%. For cotton/polyester—poly(methacrylic acid) fabric copolymer sample 15, with a PMAA add-on = 18%, the oily soiling = 88%; the oily soil removed = 62%; and the oily soil removal efficiency = 71%. The moisture regain for the unmodified cotton/polyester fabric sample G = 3.93%, and for cotton/polyester—PMAA copolymer fabric samples 14 and 15, the regains = 4.50% and 5.40%, respectively.

EXAMPLE 8

50% Cotton Fabric

OILY SOILING — Cotton (50%) and Polyester (50%) in Both Warp and Fill Constructions Three samples (Nos. 16, 17, and 18) of irradiated cotton/polyester fabric H, (which contains cotton (50%)/polyester (50%) in both the warp and the fill construction) were reacted with methacrylic acid as described in Example 4. Sample 16 was treated as was Sample 7; while Samples 17 and 18 were treated as Samples 8 and 9, respectively. The products (samples 16, 17, and 18) were cotton/polyester—poly(methacrylic acid) copolymer fabrics. A sample of unmodified cotton/polyester fabric H, (Sample H), and samples 16, 17, and 18 were soiled with an oily soil, and then, evaluated for soil release and related properties; the method employed for soiling and tests used to evaluate soil release have been referred to in Example 5. Results of evaluation tests are as follows: For unmodified cotton/-polyester sample H, with PMAA add-on = 0%, the oily soiling = 90%; the oily soil removed (SR) = 54; and the oily soil removal efficiency = 60%. For cotton/polyester—poly(MAA) copolymer fabric, Sample 16, with a PMAA add-on = 6%, the oily soiling = 91%; the oily soil removed (SR) = 64%; and the oily soil removed efficiency = 71%. For cotton/polyester—poly(MAA) copolymer fabric, Sample 17, with a PMAA-add-on = 8%, the oily soiling = 91%; the oily soil removed (SR) = 64%; and the oily soil removal efficiency = 71%. For cotton/polyester—poly(MAA) copolymer fabric, Sample 18, with PMAA-add-on = 10%, the oily soiling = 90%; the oily soil removed (SR) = 67%; and the oily soil removal efficiency = 74%. The moisture regain for the unmodified cotton/polyester fabric Sample H = 3.11%; the regain for Sample 16 = 3.70%; for Samples 17 and 18, the regain = 4.10% and 4.38%, respectively.

We claim:

1. In a process for imparting soil release and soil repellent properties to cotton and cotton-polyester blend fabrics wherein acrylic-type emulsions or solutions are employed, the improvement characterized by:
   - a single-treatment, regardless of the fabric construction or composition, consisting of covalently reacting the cotton and polyester with an acrylic-type monomer by
     - a. irradiating the cotton or cotton-polyester blend fabric to a dosage of 1 megarad,
     - b. impregnating the fabric of (*a*) with a solution 80:20, respectively, of methanol:water containing about from 2% to 15% of methacrylic acid monomer,
     - c. reacting the impregnated fabric for about from 15 to 120 minutes at ambient temperature, the time varying with the desired degree of graft polymerization, and
     - d. washing the unreacted chemicals off the reacted fabric, and drying to obtain a fabric product with a polymer add-on of about from 6% to 22%, which repels and releases aqueous soil and releases oily soil.

2. The process of claim 1 wherein the fabric composition is 50% cotton, consisting of a 50% cotton and 50% polyester blend in both the warp and the fill construction.

3. The process of claim 1 wherein the fabric composition is 75% cotton, consisting of a 100% cotton in the warp construction and a 50% cotton and 50% polyester blend in the fill construction.

4. The process of claim 1 wherein the fabric composition is 75% cotton, consisting of a 100% cotton in the fill construction and a 50% cotton and 50% polyester blend in the warp construction.

5. The process of claim 1 wherein the fabric composition is 100% cotton, consisting of 100% cotton in both the warp and fill construction.

* * * * *